US008564216B1

(12) United States Patent
Gallegos et al.

(10) Patent No.: US 8,564,216 B1
(45) Date of Patent: Oct. 22, 2013

(54) ASYMMETRIC END-OF-LIFE PROTECTION CIRCUIT FOR FLUORESCENT LAMP BALLASTS

(75) Inventors: Giovanni Gallegos, Austin, TX (US); James Koehler, Pflugerville, TX (US)

(73) Assignee: Universal Lighting Technologies, Inc., Madison, AL (US)

( * ) Notice: Subject to any disclaimer, the term of this patent is extended or adjusted under 35 U.S.C. 154(b) by 317 days.

(21) Appl. No.: 13/019,766

(22) Filed: Feb. 2, 2011

(51) Int. Cl.
*H05B 37/02* (2006.01)

(52) U.S. Cl.
USPC ..... 315/226; 315/308

(58) Field of Classification Search
USPC ..... 315/209 R, 224, 225, 226, 291, 307, 315/308; 361/42
See application file for complete search history.

(56) References Cited

U.S. PATENT DOCUMENTS 5,883,473 A * 3/1999 Li et al. ..... 315/225
6,696,798 B2 2/2004 Nishimoto et al.
6,741,043 B2 * 5/2004 Prasad ..... 315/307
7,064,499 B2 6/2006 Lott
7,154,232 B2 12/2006 Contenti et al.
7,327,101 B1 2/2008 Chen et al.
7,528,558 B2 * 5/2009 Yu et al. ..... 315/308
7,786,679 B2 8/2010 Rudolph
8,203,282 B2 * 6/2012 Yamamoto et al. ..... 315/291
2007/0296416 A1 12/2007 Lee et al.

* cited by examiner

*Primary Examiner* — Thuy Vinh Tran
(74) *Attorney, Agent, or Firm* — Waddy & Patterson, P.C.; Mark J. Patterson; Mark A. Pitchford

(57) ABSTRACT

An asymmetric end-of-life protection circuit with single-point voltage measurement is provided for an electronic ballast having two lamp connection terminals. A grounding circuit includes a capacitor and a first resistor coupled in parallel between a first lamp connection terminal and ground, and is effective to drain the second lamp connection terminal to ground. A lamp voltage detection circuit is coupled between the first lamp connection terminal and ground and measures the lamp voltage from the first lamp connection terminal. A controller is effective to shut down the ballast based on an output signal from the lamp voltage detection circuit being greater than a first predetermined threshold value or less than a second predetermined threshold value.

17 Claims, 3 Drawing Sheets

ASYMMETRIC END-OF-LIFE PROTECTION CIRCUIT FOR FLUORESCENT LAMP BALLASTS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: N/A

BACKGROUND OF THE INVENTION

The present invention relates generally to electronic ballasts for powering fluorescent lamps. More particularly, the present invention relates to ballast circuitry for detecting asymmetric end-of-life conditions in a fluorescent lamp and disabling the ballast accordingly.

In the field of electronic ballasts, an asymmetric end-of-life (AEOL) condition is associated with the operating behavior of a fluorescent lamp as it approaches the end of its life cycle. In T5 fluorescent lamps, for example, a very important end-of-life lamp characteristic is electrode degradation. With electrode degradation, the electrode operates like a large rectifying resistor. Thus, in current-controlled ballasts, the ballast will supply more power to maintain a nominal current. This extra power is dissipated in the degraded electrode. With enough power dissipation, the electrode will become hot and cause the lamp glass or lamp holder to melt or otherwise become physically unstable. This causes a dangerous situation, and accordingly AEOL protection circuitry has been developed and is known in the art to detect an asymmetric voltage disparity across lamps in contrast to the sinusoidal voltage which normally appears, and to proactively shut down the electronic ballast.

It is important to design AEOL protection circuitry to be robust and various such circuits as are conventionally known in the art are consequently more complex or less cost effective than is otherwise desirable.

BRIEF SUMMARY OF THE INVENTION

In accordance with one aspect of the present invention, an AEOL protection circuit and method are provided for detecting an AEOL condition in fluorescent lamps and disabling an associated electronic ballast.

In an aspect of certain embodiments of the present invention, an AEOL condition may be detected for various lamp types without requiring changes to circuit component parameters.

In another aspect, an AEOL condition may be detected without need for a differential voltage measurement across the one or more lamps with a ground fault capacitor present.

In another aspect, the sensitivity of the AEOL protection circuit may be easily adjusted, using a relatively simple and cost-effective circuit topology.

An embodiment of an electronic ballast in accordance with the present invention includes an inverter with first and second switching elements arranged in a half-bridge configuration. An inverter driver provides drive signals to turn on and off the first and second switching elements and generate an inverter output voltage. A resonant tank circuit is coupled to a node between the first and second switching elements, and a DC-blocking capacitor is coupled between the resonant tank circuit and a first lamp connection node. A grounding circuit includes a ground fault capacitor and a first resistor coupled in parallel between a second lamp connection node and ground, and drains the second lamp connection node to ground. A lamp voltage detection circuit is coupled between the first lamp connection node and ground and measures an output voltage across the first and second lamp connection nodes from a signal at the first lamp connection node.

An embodiment of a protection circuit for an electronic ballast in accordance with the present invention includes a grounding circuit with a capacitor and a first resistor coupled in parallel between a low-side lamp connection terminal and ground. The grounding circuit is effective to drain the low-side lamp connection terminal to ground. A voltage divider circuit includes second and third resistors coupled in series between a high-side lamp connection terminal and ground. A controller includes an input terminal coupled to a node between the second and third resistors and is effective to shut down the ballast based on a voltage-divided signal at the node being greater than a first predetermined threshold value or less than a second predetermined threshold value.

An embodiment of a method of operating an electronic ballast in accordance with the present invention includes a first step of controlling an inverter having first and second switching elements to generate a voltage across first and second lamp connection terminals. The second lamp connection terminal is drained substantially to power ground. A signal is measured at the first lamp connection terminal which is representative of a voltage across the first and second lamp connection terminals. The measured signal at the first lamp connection terminal is compared by a controller to a range defined by predetermined first and second threshold values. The controller then disables the inverter in response to a detected asymmetric end-of-life condition wherein the measured signal is outside of the defined range.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may unless otherwise stated refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Figure 1:
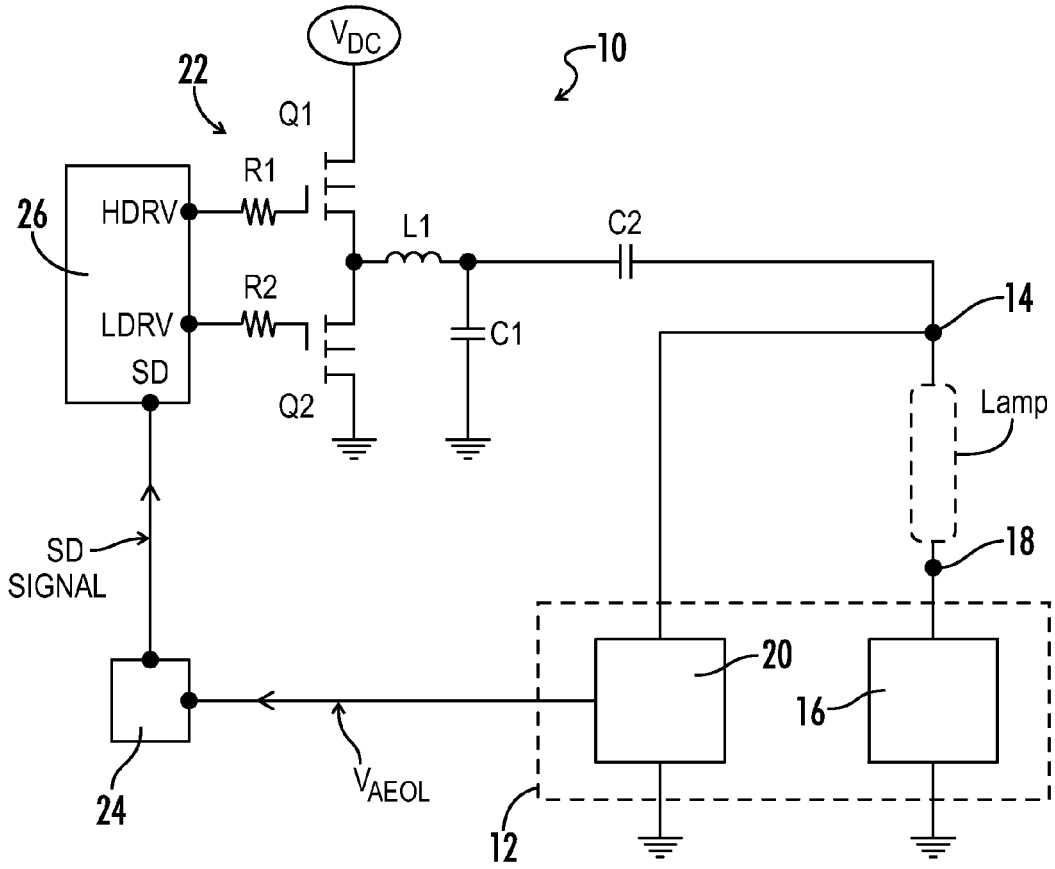
FIG. 1 is a circuit block diagram representing an embodiment of an electronic ballast in accordance with the present invention.
Figure 2:
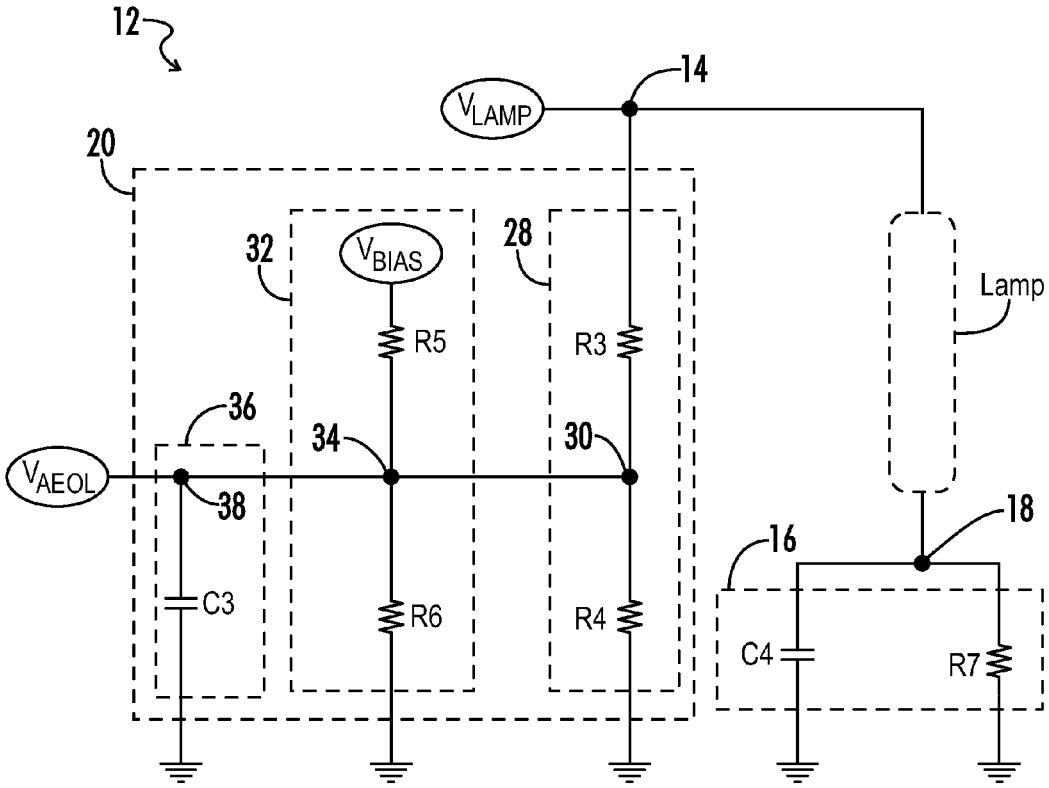
FIG. 2 is a circuit block diagram representing an embodiment of a protection circuit for an electronic ballast in accordance with the present invention.
Figure 3:
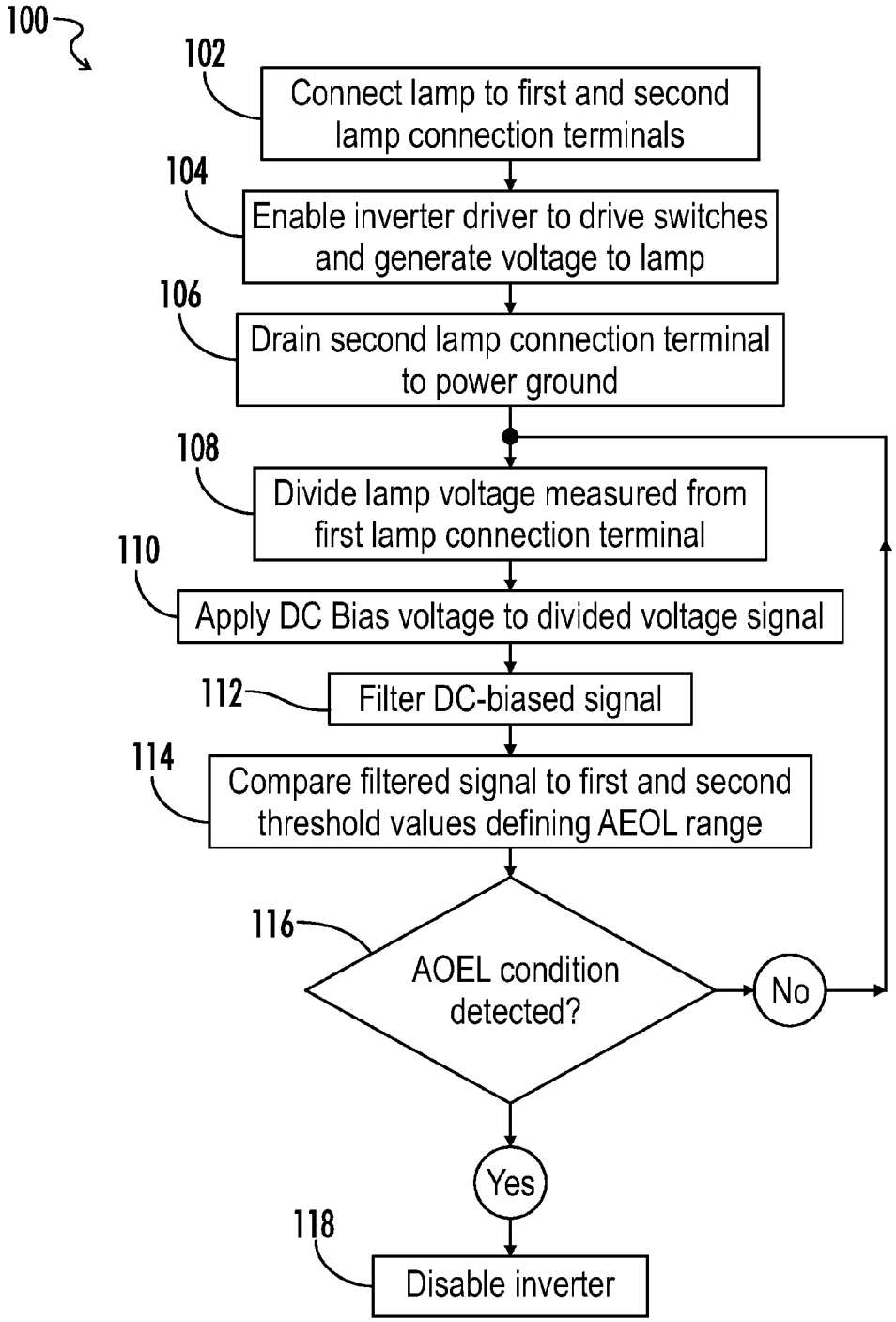
FIG. 3 is a flowchart representing an embodiment of a method of operating an electronic ballast in accordance with the present invention.

Referring generally to FIGS. 1-3, various embodiments of an electronic ballast and associated protection circuitry and methods of operation may be described herein for detecting an asymmetric end-of-life condition associated with a fluorescent lamp coupled to the ballast, and disabling the ballast upon detecting such a condition. Where the various figures may describe embodiments sharing various common elements and features with other embodiments, similar elements and features are given the same reference numerals and redundant description thereof may be omitted below.

Referring first to FIG. 1, an electronic ballast 10 according to an embodiment of the present invention includes an inverter 22 with first and second switching elements Q1, Q2 arranged in a half-bridge configuration. An inverter driver circuit 26 is coupled to the inverter 22 to provide driving signals HDRV, LDRV to the switches Q1, Q2 via resistors R1, R2, respectively. The inverter 22 is coupled between a DC rail voltage VDC and ground. A resonant tank circuit including a resonant inductor L1 and resonant capacitor C1 is coupled to a node between the first and second switching elements Q1, Q2, and a DC-blocking capacitor C2 is coupled to the resonant inductor L1. In this configuration, the capacitor C2 does not carry all of the current of the resonant tank circuit and may accordingly be designed with a smaller value. The DC-blocking capacitor C2 may however be alternatively positioned in various embodiments within the scope of the present invention.

A ballast 10 as represented in FIG. 1 further includes first and second lamp connection terminals or lamp connection nodes 14, 18 to which a gas discharge (e.g., fluorescent) lamp may be coupled, and across which a lamp voltage may be provided by the inverter 22 and resonant tank circuit L1, C1. The lamp connection nodes 14, 18 as referred to herein do not necessarily represent a physical connection terminal to which the lamps are coupled but rather an electrical equivalent in accordance with the circuit diagram. In various embodiments, additional terminals may be provided to accommodate more than one lamp, but for the present description only a single set of lamp terminals will be described herein without limitation on the scope of the present invention.

An asymmetric end-of-life (AEOL) protection circuit 12 for the electronic ballast 10 of FIG. 1 may include a grounding circuit 16 coupled to the second lamp connection node 18 that is arranged to effectively drain the second lamp connection node 18 to power ground, and a lamp voltage detection circuit 20 coupled to the first lamp connection node 14 that measures an output voltage across the first and second lamp connection nodes 14, 18 from a signal at the first lamp connection node 14 (as opposed to a differential voltage measurement).

Based on the signal at the first lamp connection node 14, an AEOL signal ($V_{_AEOL}$) may be provided to a controller 24 having an input terminal coupled to the lamp voltage detection circuit 20. In various embodiments the controller 24 may be effective to disable the inverter 22 based on a comparison of the AEOL signal from the lamp voltage detection circuit 20 to a first predetermined threshold value and to a second predetermined threshold value. The controller 24 as represented in FIG. 1 may provide an inverter shutdown signal SD to a shutdown input terminal on the inverter driver circuit 26 wherein the inverter driver disables the inverter 22 and thereby the electronic ballast 10 in response to a detected AEOL condition.

The controller 24 and driver circuit 26 as referred to herein may each include at least a general microprocessor, an application specific integrated circuit (ASIC), a digital signal processor (DSP), a microcontroller, a field programmable gate array, or various alternative blocks of discrete circuitry as known in the art, configured and/or programmed as is known in the art to implement and perform the functions as further defined herein. In alternative embodiments, the controller 24 and driver 26 as represented in FIG. 1 may be implemented n a single integrated circuit or other equivalent topologies as may be understood by one of skill in the art.

Referring now to FIG. 2, an embodiment of the AEOL protection circuit 12 may be described in greater detail. The grounding circuit 16 includes a ground fault capacitor C4 and a resistor R7 coupled in parallel between the second lamp connection node 18 and ground. The lamp voltage detection circuit 20 includes a voltage divider circuit 28 having a pair of resistors R3, R4 coupled in series between the first lamp connection node 14 and ground. A DC biasing circuit 32 includes a pair of resistors R5, R6 coupled in series between a DC bias source V_bias and ground, with a node 34 between the resistors R5, R6 coupled to a node 30 between the pair of resistors R3, R4. A filtering circuit 36 includes a capacitor C3 coupled to ground and to a node 38 further coupled between the controller input terminal and the DC biasing circuit node 34.

Referring now to FIG. 3, an embodiment of a method 100 of operating an electronic ballast 10 having an AEOL protection circuit 12 in accordance with the present invention may now be described.

As a first or preliminary step (102) a lamp may be connected to first and second lamp terminals 14, 18 associated with the electronic ballast, after which time an inverter driver 26 may be enabled (step 104) to drive inverter switching elements Q1, Q2 on and off to generate an output voltage V_lamp.

The grounding circuit 16 during operation of the lamp drains the DC voltage across the lamp to near zero (step 106). The resistor R7 of the grounding circuit 16 may be chosen to be substantially greater in impedance than the ground fault capacitor C4 at operating frequencies, vet substantially lower in impedance than the DC impedance to ground at node 14 wherein the second lamp connection node 18 is substantially near power ground. Therefore, instead of needing to measure a differential voltage across the lamp, only a single voltage needs to be measured at the first lamp connection node 14.

The lamp voltage detection circuit 20 (as represented for example in FIG. 2) may be used to obtain the voltage across the lamp V_lamp at the first lamp connection node 14. First, a voltage divider circuit 28 divides the lamp voltage V_lamp, which can generally be a relatively high value which may be impractical for direct measurement by the lamp voltage detection circuit. In an embodiment as represented in FIG. 2, resistors R3, R4 are coupled to the first lamp connection node and have a ratio such that the voltage across resistor R4 is made relatively small (step 108).

This voltage-divided signal is then DC biased by the DC biasing circuit 32 including the DC bias voltage source V_bias and the resistors R5, R6 (step 110). The voltage source V_bias may be of a sufficiently low voltage type that the DC biasing circuit 32 provides a DC bias that may be fed into a desired controller (e.g., a microcontroller unit as conventionally known in the art). In various embodiments a sub-step to step 110 may include setting the values of resistors R5, R6 of the DC biasing circuit 32 accordingly to change the sensitivity of asymmetric detection by the AEOL protection circuit 12 generally. The DC-biased signal may then be filtered by a filtering capacitor C3 before it is then fed to the controller 24 as $V_{AEOL}$ (step 112).

The controller 24 may be configured at this stage to compare the filtered signal $V_{AEOL}$ to first and second threshold values which define a range associated with detection of AEOL conditions (step 114). During a normal operating (non-AEOL) condition, the filtered signal $V_{AEOL}$ fed into the controller 24 remains at a voltage level set by the DC biasing circuit 32.

During an AEOL condition the filtered signal $V_{AEOL}$ will increase if there is a positive asymmetric disparity, and decrease if there is a negative asymmetric disparity across the lamp connection nodes 14, 18 or otherwise stated across the lamp.

In an embodiment, the controller 24 may compare the received signal $V_{AEOL}$ to first and second predetermined absolute positive values, wherein a received signal greater than the first predetermined threshold value or less than the second predetermined threshold value is indicative of a detected AEOL condition on the lamp. In another embodiment, the controller 24 may compare a variation of the received signal $V_{AEOL}$ from a predetermined DC bias applied by the DC biasing circuit against a predetermined upper and lower offset threshold value, wherein a variation greater the predetermined upper offset value or less than the predetermined lower offset value is indicative of a detected AEOL condition on the lamp.

In embodiments of the present invention where the output signal $V_{AEOL}$ from the lamp voltage detection circuit has been DC biased to a predetermined voltage, the DC bias may thereby not be dependent on the voltage V_lamp used to operate the lamp itself. This allows the AEOL protection circuit to work with various types of lamps without the need to adjust circuit components or component values accordingly.

If an AEOL condition is detected by the controller based on the comparison (i.e., "yes" in response to the query in step 116), the controller proceeds to supply a shutdown signal to the inverter driver circuit 26, whereby the ballast is disabled (step 118). In certain embodiments the inverter driver circuit 26 may disable the ballast by terminating switching operations in the inverter, but alternative methods of performing the disabling step may include, for example, raising the switching frequency in the inverter well above the normal operating frequency such that a relatively low output power is provided by the inverter. The process by which the ballast is disabled in accordance with step 118 is therefore outside of the scope of the present invention, as various processes are well known in the art having an equivalent function.

If an AEOL condition is not detected by the controller based on the comparison (i.e., "no" in response to the query in step 116), the process merely returns to step 108 or an equivalent segment of the aforementioned method 100 and continues operating the lamp and monitoring the lamp voltage for an AEOL condition.

The previous detailed description has been provided for the purposes of illustration and description. Thus, although there have been described particular embodiments of the present invention of a new and useful "Asymmetric End-of-Life Protection Circuit for Fluorescent Lamp Ballasts," it is not intended that such references be construed as limitations upon the scope of this invention except as set forth in the following claims.

What is claimed is:

1. An electronic ballast comprising:

an inverter;

an inverter driver circuit effective to provide drive signals to the inverter to cause the inverter to generate an inverter output voltage at an inverter output;

a resonant tank circuit coupled to the inverter output;

first and second lamp connection nodes;

a DC-blocking capacitor coupled between the resonant tank circuit and the first lamp connection node;

a grounding circuit comprising a ground fault capacitor and a first resistor coupled in parallel between the second lamp connection node and ground, the grounding circuit effective to drain the second lamp connection node to ground;

a lamp voltage detection circuit coupled between the first lamp connection node and ground and effective to measure an output voltage across the first and second lamp connection nodes from a signal at the first lamp connection node;

a controller having a controller input terminal coupled to the lamp voltage detection circuit and effective to disable the inverter based on a received signal from the lamp voltage detection circuit being greater than a first predetermined threshold value or less than a second predetermined threshold value; and the lamp voltage detection circuit comprising a voltage divider circuit further comprising second and third resistors coupled in series between the first lamp connection node and ground, the controller input terminal coupled to a node between the second and third resistors.

2. The ballast of claim 1, the lamp voltage detection circuit further comprising a biasing circuit coupled between the voltage divider circuit and the controller input and effective to generate a predetermined DC bias with respect to the voltage-divided signal from the voltage divider circuit, and the controller is effective to shut down the inverter based on a DC-biased signal at the controller input being greater than a first positive threshold value or less than a second positive threshold value.

3. The ballast of claim 2, the first and second threshold values both being absolute positive values to which the DC-biased signal is compared by the controller to determine an asymmetric end-of-life condition for an associated lamp.

4. The ballast of claim 3, the DC bias voltage source being independent of the inverter output voltage wherein the lamp voltage detection circuitry is independent of a type of lamp.

5. The ballast of claim 2, the first and second threshold values both being predetermined offset values with respect to the DC bias provided to the voltage-divided signal, the controller effective to determine an asymmetric end-of-life condition for an associated lamp when the DC-biased signal is greater than the DC bias plus the first predetermined offset value or less than the DC bias minus the second predetermined offset value, and wherein the DC bias minus the second predetermined offset value is a positive value.

6. The ballast of claim 2, the biasing circuit comprising fourth and fifth resistors coupled in series between a DC bias voltage source and ground, and a node between the fourth and fifth resistors is coupled to the node between the second and third resistors and is further coupled to the controller input.

7. The ballast of claim 2, further comprising a filtering capacitor coupled to a node between the biasing circuit and the controller input and effective to filter the DC-biased signal.

8. A protection circuit for an electronic ballast having first and second lamp connection terminals, the protection circuit comprising:

a grounding circuit comprising a capacitor and a first resistor coupled in parallel between the second lamp connection terminal and ground, the grounding circuit effective to drain the second lamp connection terminal to ground;

a voltage divider circuit comprising second and third resistors coupled in series between the first lamp connection terminal and ground; and a controller having an input terminal coupled to a node between the second and third resistors and effective to shut down the ballast based on a voltage-divided signal at said node being greater than a first predetermined threshold value or less than a second predetermined threshold value.

9. The protection circuit of claim 8, further comprising a biasing circuit coupled between the voltage divider circuit and the controller and effective to generate a predetermined DC bias signal with respect to the voltage-divided signal from the voltage divider circuit, and the controller is effective to shut down the inverter based on a DC-biased signal at the controller input being greater than a first positive threshold value or less than a second positive threshold value.

10. The protection circuit of claim 9, the first and second threshold values both being absolute positive values to which the DC-biased signal is compared by the controller to determine an asymmetric end-of-life condition for an associated lamp.

11. The protection circuit of claim 9, the first and second threshold values both being predetermined offset values with respect to the DC bias provided to the voltage-divided signal, the controller effective to determine an asymmetric end-of-life condition for an associated lamp when the DC-biased signal is greater than the DC bias plus the first predetermined offset value or less than the DC bias minus the second predetermined offset value, and wherein the DC bias minus the second predetermined offset value is a positive value.

12. The protection circuit of claim 9, the biasing circuit comprising fourth and fifth resistors coupled in series between a DC bias voltage source and ground, a node between the fourth and fifth resistors coupled to the node between the second and third resistors and further coupled to the controller input.

13. The protection circuit of claim 12, the DC bias voltage source being independent of a lamp voltage provided by the ballast wherein the selection of protection circuit components is independent of a type of lamp.

14. The protection circuit of claim 9, further comprising a filtering capacitor coupled to a node between the biasing circuit and the controller input and effective to filter the DC-biased signal.

15. A method of operating an electronic ballast, the method comprising:

controlling an inverter to generate a voltage across first and second lamp connection terminals;

draining the second lamp connection terminal substantially to power ground;

measuring a signal at the first lamp connection terminal, the signal being representative of a voltage across the first and second lamp connection terminals;

comparing the measured signal at the first lamp connection terminal to a range defined by predetermined first and second threshold values;

disabling the inverter in response to a detected asymmetric end-of-life condition wherein the measured signal is outside of the defined range; and wherein the step of measuring a signal at the first lamp connection terminal further comprises the steps of:

dividing a voltage at the first lamp connection terminal with a voltage divider circuit comprising a pair of resistors coupled to the first lamp connection terminal;

providing a predetermined DC bias to a voltage-divided signal at a node between the pair of resistors; and filtering the DC-biased signal and providing the filtered signal to a controller.

16. The method of claim 15, wherein the step of comparing the measured signal at the first lamp connection terminal to a range defined by predetermined first and second threshold values further comprises comparing in the controller the filtered signal to a range defined by predetermined first and second positive threshold values.

17. The method of claim 15, wherein the step of comparing the measured signal at the first lamp connection terminal to a range defined by predetermined first and second threshold values further comprises comparing in the controller the filtered signal to a range defined by predetermined first and second offset values with respect to the predetermined DC bias.

* * * * *